US005375846A

United States Patent [19]

Smith

[11] Patent Number: 5,375,846

[45] Date of Patent: Dec. 27, 1994

[54] SEXUAL ETIQUETTE GAME APPARATUS AND METHOD

[76] Inventor: Robert J. Smith, 1214 N. Charles St. #210, Baltimore, Md. 21201

[21] Appl. No.: 233,286

[22] Filed: Apr. 25, 1994

[51] Int. Cl.[5] ..... A63F 1/00; A63F 9/18

[52] U.S. Cl. ..... 273/292; 273/430

[58] Field of Search ..... 273/292, 243, 249, 296, 273/429–432

[56] References Cited

U.S. PATENT DOCUMENTS

| | | | |
|---|---|---|---|
| 4,273,337 | 6/1981 | Carrera et al. | 273/243 |
| 4,635,939 | 1/1987 | Makow | 273/296 |
| 5,054,775 | 10/1991 | Banks et al. | 273/431 |
| 5,230,517 | 7/1993 | Peacock | 273/432 |

OTHER PUBLICATIONS

Games Magazine, "Dr. Ruth's Game of Good Sex", Feb., 1986, p. 50.

*Primary Examiner*—Benjamin H. Layno

[57] ABSTRACT

Game playing apparatus includes a set of cards each bearing a descriptive synopsis of a potentially ambiguous or embarrassing situational dilemma involving sexual etiquette. Also provided are a set of role play cards each instructing the players to assume the sexual role indicated symbolically on the card and answer the current question accordingly. Players are dealt four or five dilemma cards each and the role play cars are placed accessibly between the players. Each player in turn reads aloud the situation described on a card and shares his or her opinion on how the dilemma should best be resolved. If the other players are in general agreement with the resolution, the round is over and the next player reads and responds to one of his or her situation cards. If one or more players differ with the resolution posed, the dealer calls for and moderates an open discussion on the merits of alternative solutions. At any time during the discussion period any player may have his or her opinion challenged as sex-biased by any other player and required to rephrase his or her answer from the viewpoint of the opposite sex. Play continues until all dealt cards have been discussed whereupon each player rates himself and each of the other players perceived sexual sensitivity. The player with the highest total is deemed "winner" with the privilege of posing any sexual dilemma of his or her choice to the group.

22 Claims, 2 Drawing Sheets

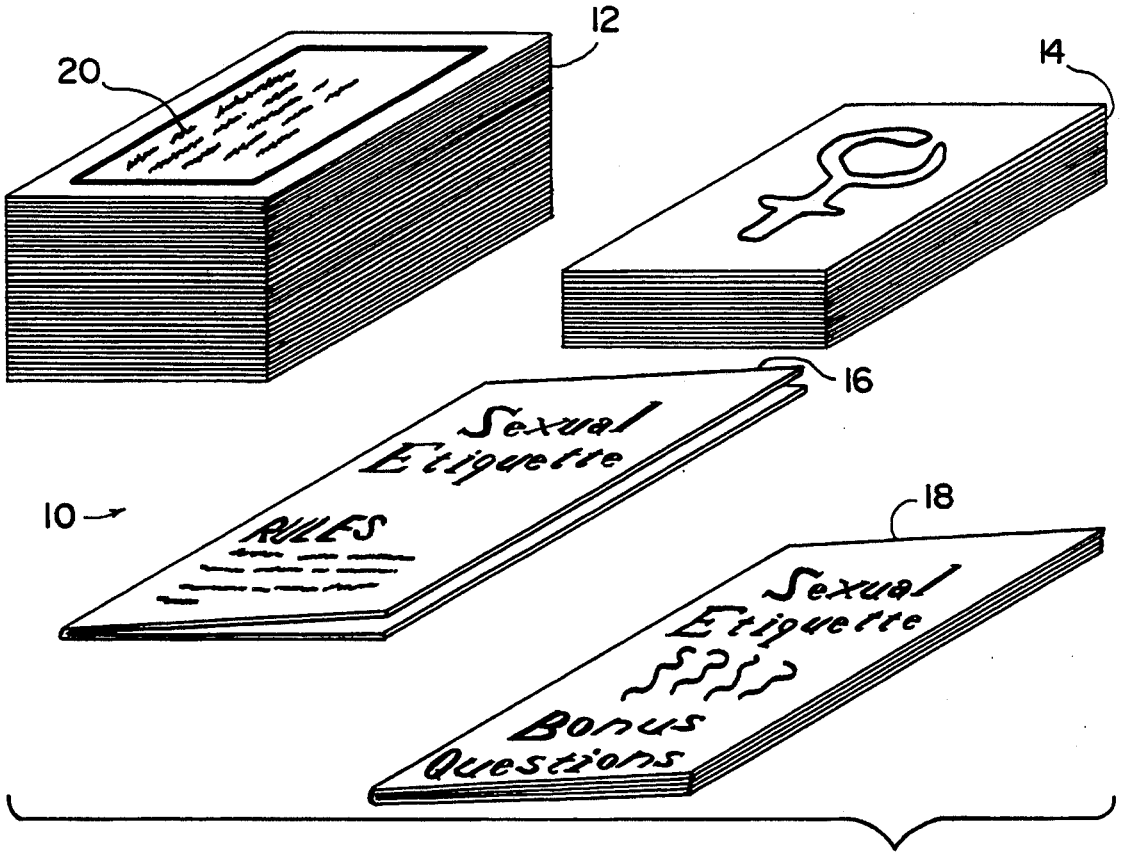
FIG. 1
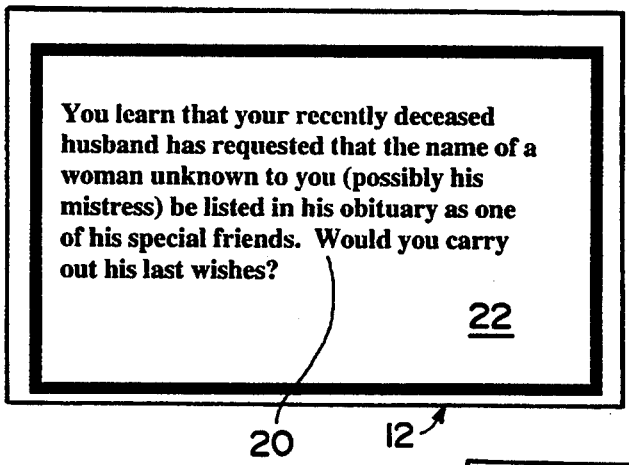
FIG. 2
FIG. 3
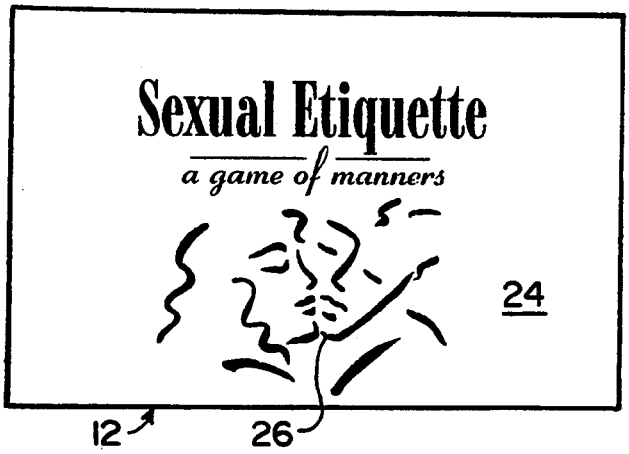

SEXUAL ETIQUETTE GAME APPARATUS AND METHOD

BACKGROUND OF THE INVENTION

1. Technical Field

The present invention relates generally to games and gaming apparatus, and more particularly, to a sexual etiquette discussion game which challenges players' interpretation of and sensitivity to situational dilemmas.

2. Discussion of the Prior Art

There are various games involving exchanges of questions and answers concerned with knowledge of or attitudes about ethics, relationships and sexual conduct. Usually these games treat the inquiry process as a means for provoking humorous and entertaining responses and to accumulate premiums or penalties in accord with arbitrary or consensus judgements of the "correctness" of the answers. One genre of such games, characterized by U.S. Pat. No. 5,230,517 (Peacock), uses sexually oriented questions posed by one player to another, as part of random chance generated progress around a game board, to act as an "icebreaker" in a primarily social acquaintanceship process.

In another type of game, represented by U.S. Pat. No. 4,273,337 (Carrera et al), specific questions involving human sexuality are asked of each player in response to playing piece location on a game board. Answers are judged against reference answers provided. Correct answers allow players to advance. General discussion is incorporated periodically into the play of the game to encourage instructive interaction between parents and children on simple unambiguous topics.

Games based on the abilities of players to accurately predict the responses of other players to moral questions, exemplified by U.S. Pat. No. 4,635,939 (Makow), may include challenges requiring verbal justification of answers and assessments of a respondent's sincerity.

None of these games, however, foster free-wheeling discussion of sexuality-related issues nor focus on self-understanding and self-improvement with particular emphasis on overcoming sexual bias in the analysis of perplexing real-life situations.

SUMMARY OF THE INVENTION

Accordingly, it is a primary object of the present invention to overcome the above-mentioned disadvantages of the prior art by providing a novel game apparatus and method of playing to provide both the stimulus and the framework to encourage open discussion among players of the proper etiquette for various real-life situations involving issues of human sexuality.

It is another important object of the present invention to teach individuals sensitivity to the points of view on sexual issues of persons of the opposite sex, persons having different sexual preferences or orientations, and, in general, persons of different background and status.

Another object is to provide a game of situation analysis emphasizing appreciation for opposite-sex viewpoints.

Yet another object of the present invention is to provide a method of game-playing to heighten each player's awareness of how his or her sexual attitudes relate to others and are perceived by others.

The present invention is generally characterized as an apparatus and a method for playing a game of group communication on human sexuality topics contained on situation cards dealt to the players and discussed in turn in a moderated setting. Players may be required to rephrase opinions playing the role of a member of the opposite sex. After all the dealt cards have been discussed, players rate each other in terms of sexual etiquette, based on the discussions, followed by another round of discussion to clarify the rationales involved in the appraisals. The player accorded the highest sexual etiquette rating may be allowed to pose a situational dilemma of his or her choosing to the group of players.

Some of the advantages of the present invention over the prior art include the establishment of a provocative and stimulating forum for players to organize and express feelings related to difficult situations and to profit from group critique in an encouraging and structured setting, the absence of banal chance competition to interfere with the flow of intellectual and emotional response, and the opportunity to confront sex-based bias by role-playing several viewpoints on the same controversial issue. Sufficient competition is inherent to the game play to maintain amusement and lightness without trivializing the learning and sensitizing aspects of the situation analysis. The game can be played by any number of players, requires little equipment or space, is easily understood and is inexpensive to manufacture.

Other objects and advantages of the present invention will become apparent from the following description of the preferred embodiments taken in conjunction with the accompanying drawings.

BRIEF DESCRIPTION OF THE DRAWINGS

FIG. 1 is a perspective view of the game apparatus of the present invention.

FIG. 2 shows the front side of one of the sexual dilemma cards.

FIG. 3 shows the reverse side of a sexual dilemma card.

DESCRIPTION OF THE PREFERRED EMBODIMENT

Figure 5:
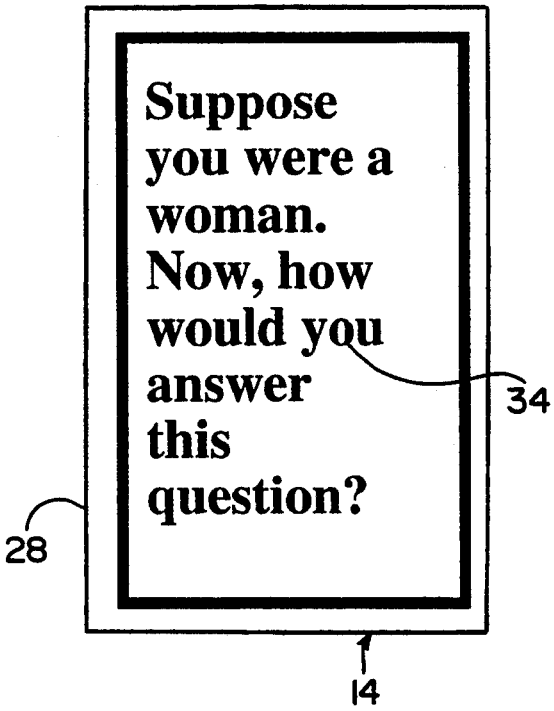
FIG. 5 shows the reverse side of a female role play card.
Figure 4:
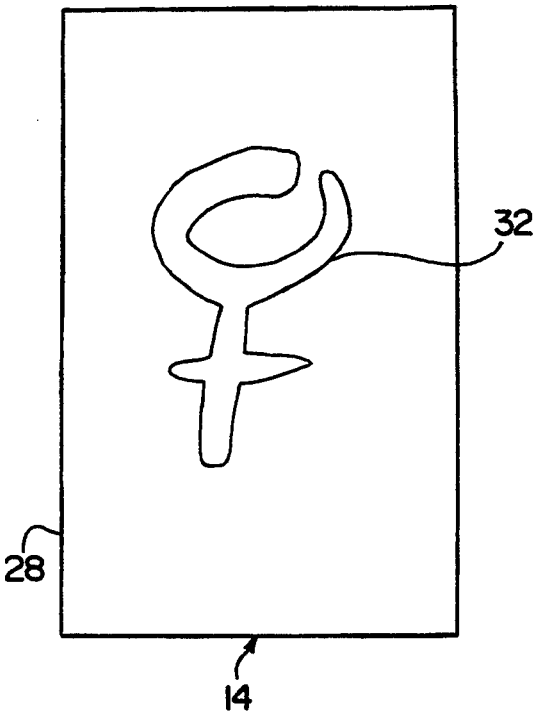
FIG. 4 shows the front side of a female role play card.
Figure 6:
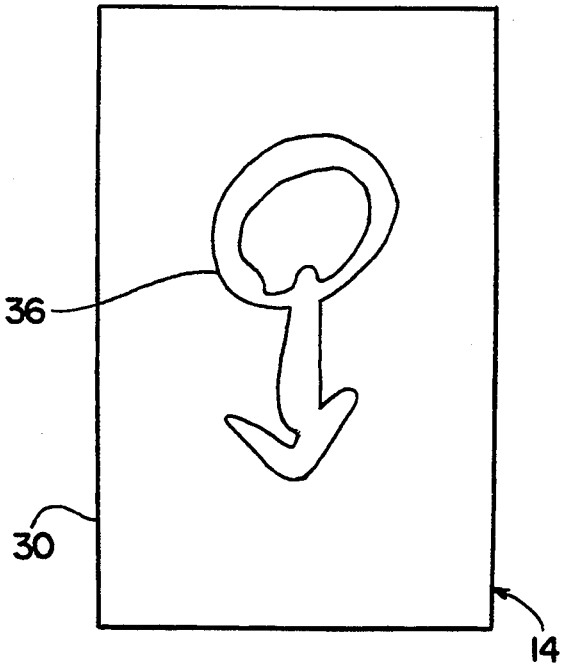
FIG. 6 shows the front side of a male role play card.
Figure 7:
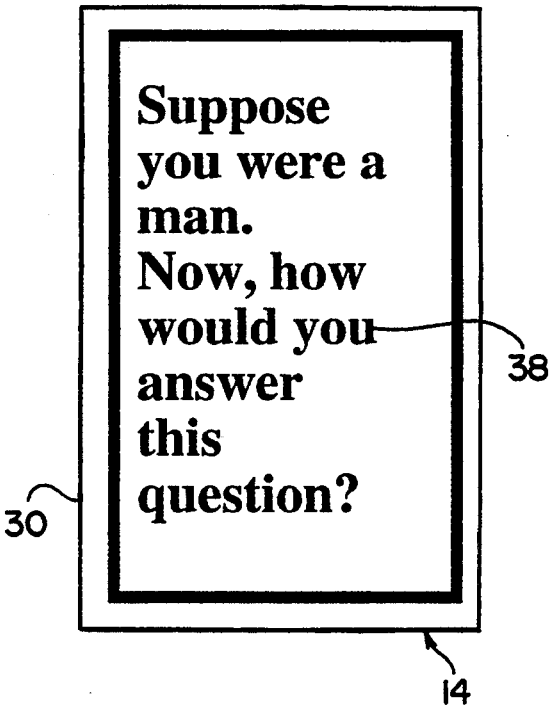
FIG. 7 shows the reverse side of a male role play card.

The game apparatus of the present invention 10 comprises a first and a second set of playing cards 12 and 14, respectively, shown in FIGS. 2–7, packaged along with a printed booklet of game rules 16 and a separate booklet 18 of bonus questions to be used as an adjunct to the playing cards. A first set of cards 12, preferably about four hundred or more in number, referred to hereinafter as dilemma cards, have short paragraphs 20 describing sexually-related social scenarios or dilemmas imprinted on the front side 22, as shown in FIG. 2. Each dilemma includes or is followed by a question to be answered by the players relating to the proper, socially correct response or behavior appropriate to the situation. Examples of such sexual issues or dilemmas include "As a minister, you are counseling a married couple in conflict over whether oral sex is right or wrong. What advice would you give them?" and "One evening while returning from a shopping trip, Laverne, who is HIV positive, was attacked, knocked unconscious and raped. Should she inform the legal authorities about her HIV status?".

The reverse side 24 of each dilemma card is imprinted with identical characteristic patterns 26 rendering the cards indistinguishable one from another when viewed from the reverse side.

A second set of cards 14, referred to hereinafter as role play cards, comprises a first and a second subset 28 and 30 respectively of about five cards each. These cards are used to introduce gender reversal role playing into the process of analyzing the appropriate sexual etiquette required for the dilemmas contained on the first set of cards. The first subset 28 has an artistic rendering 32 of the symbol for the female sex imprinted on the front side, shown in FIG. 4, and an instruction 34 to "Suppose you were a woman. Now, how would you answer this question?" imprinted on the reverse side, shown in FIG. 5. Second subset 30 has an artistic rendering 36 of the symbol for the male sex imprinted on the front side, shown in FIG. 6, and instruction 38 to "Suppose you were a man. Now, how would you answer this question?" imprinted on the reverse side, shown in FIG. 7.

The rules booklet 18 describes the play of the game and defines the role of one player as dealer of the dilemma cards and as moderator for the ensuing discussions. A scoring system is presented to reach a group consensus of the sensitivity or sexual etiquette of each player. Separate booklet 18 contains supplemental dilemmas and scenarios to augment the dilemma card set 12.

To play Sexual Etiquette TM, the players choose one player to be the dealer. The role play cards are separated into the two male and female subsets and placed within reach of the players. The dealer shuffles a number of sexual issue or dilemma cards and deals four or five cards to each player, including him or herself. First, the dealer selects one of his or her dilemma cards and reads the imprinted paragraph aloud to the assembled group of players. The dealer then answers aloud the question as to how the dealer believes the situation should be handled. Each other player, beginning to the left of the dealer and continuing clockwise to the others, is polled to determine if he or she agrees with the dealer's solution, and is given an opportunity to express an opinion on alternative etiquette to be applied to the situation. If all the players are in general agreement in the opinion of the dealer acting as moderator, then the next player to the dealer's left selects one of his or her dilemma cards, and reads aloud and offers a solution to the printed dilemma. Play continues in this fashion with the turn passing to the players' left, or clockwise, until all the dealt dilemma cards have been discussed. Each time players differ on how a situation should be handled, the dealer declares "Discussion" and the players engage in an open free-wheeling discussion, managed as unobtrusively as possible by the dealer. The dealer acts as referee and moderator and controls the flow of the discussion to ensure that everyone's opinion is heard and that the game continues to the next dilemma after a reasonable period of time. It is not an object that the players reach a unanimous agreement but rather that all players' opinions on the controversial issue be aired.

At any time during the discussion any player may challenge the sex bias of any other player's opinion by selecting an appropriate role play card from the stacks arranged in front of the players and presenting that role play card to the challenged player. A man would be asked to rethink his opinion from the point of view of a woman or a woman player would be requested to consider the situation from a male perspective. Discussion then resumes until a natural conclusion evolves or the dealer signals an end to the discussion and play moves clockwise to the next player to read a new card.

After all the dealt cards have been discussed, each player scores him or herself and each other player according to the perceived level of sexual etiquette and sensitivity using a scoring system consisting of zero for "Awful Sexual Etiquette", one for "Poor Sexual Etiquette", two for "Good" and three for "Excellent". The player given the highest overall score is declared winner and can pose any sexual etiquette situation to the group for discussion that he chooses.

An additional round of discussion following the announcement of the scores is most useful and enlightening. The topic of this round is the rationales and perceptions that resulted in the scores. It is during this discussion that the difference between self-image and the perception of others is confronted and sensitively heightened.

Other scoring systems could be applied, including a one to ten scale, and scoring could be done after each discussion or round of discussions rather than at the end of play. Additional role-playing and sensitivity heightening opportunities can be included by adding cards requiring players to assume the point of view of a male or female gay person or a person with a positive HIV test or active AIDS virus. Other role playing cards can require players to assume the point of view of persons of different age, different marital status, different economic status, different ethnicity (including religions), etc., on the sexual issue being discussed. In this manner the game serves as a teaching tool to foster enhanced sensitivity to the points of view of others on sexually oriented issues.

Inasmuch as the present invention is subject to many variations, modifications and changes in detail, it is intended that the subject matter discussed above and shown in the accompanying drawings be interpreted as illustrative and not in a limiting sense.

What is claimed is:

1. Game playing apparatus comprising:

(a) a first set of cards each having imprinted on one side thereof a short paragraph describing a sexually-related social dilemma and a question related to said dilemma to which players respond, each of said cards having a different social dilemma imprinted thereon; and (b) a second set of cards each having imprinted thereon instruction to respond to said question from the role-playing viewpoint of a particular gender, a plurality of said cards indicating said gender to be male, a plurality of said cards indicating said gender to be female.

2. The apparatus according to claim 1 further comprising a booklet containing supplemental sexually-related social dilemmas to augment said first card set.

3. The apparatus according to claim 1 wherein said second set of cards is imprinted with symbols corresponding to and indicating the gender specified by said instruction.

4. The apparatus according to claim 1 wherein said second set of cards further includes cards having imprinted thereon instruction to respond to said question from the role-playing viewpoint of a person of a specific age group.

5. The apparatus according to claim 1 wherein said second set of cards further includes cards having imprinted thereon instruction to respond to said question from the role-playing viewpoint of a person of a specific ethnic background.

6. The apparatus according to claim 1 wherein said second set of cards further includes cards having imprinted thereon instruction to respond to said question from the role-playing viewpoint of a person of a specific religious background.

7. The apparatus according to claim 1 wherein said second set of cards further includes cards having imprinted thereon instruction to respond to said question from the role-playing viewpoint of a person of a specific economic background.

8. The apparatus according to claim 1 wherein said second set of cards further includes cards having imprinted thereon instruction to respond to said question from the role-playing viewpoint of a person of a specific sexual preference background.

9. The apparatus according to claim 1 wherein said second set of cards further includes cards having imprinted thereon instruction to respond to said question from the role-playing viewpoint of a person who has tested HIV positive.

10. The apparatus according to claim 1 wherein said second set of cards further includes cards having imprinted thereon instruction to respond to said question from the role-playing viewpoint of a person who has AIDS.

11. The method of playing a game by a plurality of players comprising:

(a) establishing a set of sexually-related social dilemmas and questions related to said dilemmas;

(b) establishing a set of distinctive role-playing viewpoints;

(c) selecting a first player to act as moderator and to distribute one or more of said dilemmas from said set to each player;

(d) reading aloud by said first player a dilemma selected from said dilemmas distributed to said first player;

(e) answering aloud said question posed by said dilemma by said first player;

(f) polling of each other player to determine general agreement or disagreement with the answer of said first player;

(g) engaging all of said players in an open discussion of alternative answers moderated by said first player;

(h) allowing any of said players to require any other of said players to respond to said question from the viewpoint of one of said role-playing viewpoints;

(i) ending said discussion after a period of time determined by said first player-moderator; and (j) repeating steps (c) through (g) for each player in turn until all of said dilemmas distributed in step (b) have been discussed.

12. The method of claim 11 further comprising the steps of:

(k) scoring by each player of the perceived sexual etiquette and sensitivity of each player based on said answers and discussions generated in steps (e), (g) and (h); and (l) summing all said scores for each player to determine group perceptions of player etiquette and sensitivity.

13. The method of claim 12 further comprising the step of:

(m) engaging all of said players in an open discussion of the rationales and perceptions resulting in said scores.

14. The method of claim 13 further comprising the step of:

(n) posing for player discussion a dilemma formulated by the player scoring highest in step (l).

15. The method of teaching individuals sensitivity on sexually-related issues to the viewpoints of others comprising:

(a) establishing a set of sexually-related social dilemmas and related questions;

(b) establishing a set of distinctive role-playing viewpoints;

(c) distributing one or more of said dilemmas and questions from said set to each player;

(d) having each player in turn read aloud one of said dilemmas and questions and answer said question aloud;

(e) polling of all other players to determine general agreement or disagreement with said answer;

(f) engaging all of said players in open discussion of alternative answers to said question;

(g) allowing any of said players to require any other of said players to respond to said question from the viewpoint of one of said role-playing viewpoints;

(h) scoring by each player of the perceived sexual etiquette and sensitivity of each player based on said answers and discussions; and (i) engaging all of said players in a discussion of the rationales and perceptions resulting in said scores.

16. The method of claim 15 wherein said role-playing viewpoints includes the viewpoints of specific age groups.

17. The method of claim 15 wherein said role-playing viewpoints includes the viewpoints of specific ethnic groups.

18. The method of claim 15 wherein said role-playing viewpoints includes the viewpoints of specific religious groups.

19. The method of claim 15 wherein said role-playing viewpoints includes the viewpoints of specific economic status groups.

20. The method of claim 15 wherein said role-playing viewpoints includes the viewpoints of specific sexual preference groups.

21. The method of claim 15 wherein said role-playing viewpoints includes the viewpoints of persons tested HIV positive.

22. The method of claim 15 wherein said role-playing viewpoints includes the viewpoints of persons having AIDS.

* * * * *